US008240159B2

(12) United States Patent
Prabhakar et al.

(10) Patent No.: US 8,240,159 B2
(45) Date of Patent: Aug. 14, 2012

(54) IN-DOOR FLUID DRAINAGE SYSTEM FOR A REFRIGERATOR

(75) Inventors: Ragavendra Prabhakar, Hyderabad (IN); Mahesh Natarajan, Hyderabad (IN); Pranav Mittal, Karnataka (IN); Martin Zentner, Prospect, KY (US); Matthew William Davis, Prospect, KY (US)

(73) Assignee: General Electric Company, Schenectady, NY (US)

( * ) Notice: Subject to any disclaimer, the term of this patent is extended or adjusted under 35 U.S.C. 154(b) by 511 days.

(21) Appl. No.: 12/492,539

(22) Filed: Jun. 26, 2009

(65) Prior Publication Data

US 2010/0326112 A1 Dec. 30, 2010

(51) Int. Cl.
*F25B 1/00* (2006.01)

(52) U.S. Cl. ..... 62/115; 62/340

(58) Field of Classification Search ..... 62/340, 62/248, 259.1, 291, 285, 288, 441, 449; 312/116, 312/229; 137/314, 341
See application file for complete search history.

(56) References Cited

U.S. PATENT DOCUMENTS

| | | | | |
|---|---|---|---|---|
| 3,696,632 | A | 10/1972 | Carlin et al. | |
| 4,783,971 | A | 11/1988 | Alba | |
| 4,843,835 | A * | 7/1989 | Goetz et al. | 62/285 |
| 4,876,861 | A | 10/1989 | Tanaka et al. | |
| 5,199,273 | A * | 4/1993 | Silva et al. | 62/298 |
| 5,271,241 | A | 12/1993 | Kim | |
| 5,971,213 | A * | 10/1999 | Lee | 222/146.6 |
| 6,708,518 | B1 * | 3/2004 | Jones et al. | 62/389 |
| 7,386,984 | B2 * | 6/2008 | Zhang et al. | 62/6 |
| 7,437,885 | B2 | 10/2008 | Wu et al. | |
| 2004/0182103 | A1 * | 9/2004 | Jung | 62/389 |
| 2005/0173323 | A1 * | 8/2005 | Meuleners et al. | 210/184 |
| 2006/0207282 | A1 * | 9/2006 | Visin et al. | 62/351 |
| 2006/0277928 | A1 * | 12/2006 | McDougal et al. | 62/66 |
| 2006/0277934 | A1 * | 12/2006 | Cho | 62/285 |
| 2007/0080102 | A1 * | 4/2007 | Cur et al. | 210/235 |
| 2008/0011008 | A1 * | 1/2008 | Cur et al. | 62/338 |
| 2009/0000326 | A1 * | 1/2009 | Bang | 62/288 |

* cited by examiner

*Primary Examiner* — Mohammad Ali
(74) *Attorney, Agent, or Firm* — GE Global Patent Operation; Peter T. DiMauro

(57) ABSTRACT

An in-door fluid drainage system for a refrigerator is disclosed. The drain fluid transfer system is described as extending from the door of a refrigerator to the lower compartment for transfer of drain fluid from the door to a drain fluid removal system. Also described is a drain fluid transfer system which comprises one or both of a transfer tube at least partially enclosed in a hinge assembly, and a valve assembly positioned at the lower portion of the door.

14 Claims, 9 Drawing Sheets

IN-DOOR FLUID DRAINAGE SYSTEM FOR A REFRIGERATOR

BACKGROUND OF THE INVENTION

The present invention relates to a fluid drainage system for a refrigerator. More particularly, the present invention relates to a fluid drainage system for removing drain fluid from a door of a refrigerator.

Current refrigerator designs include a trap or other removal means for the collection of water that has, for example, thawed, due to changes in temperature in a freezer section of a refrigerator unit. For example, ice that is in a freezer compartment may release a small amount of water when the temperature of the freezer section changes. Such changes in temperature may occur when the freezer door is left opened for an extended period of time. Water may also be developed through a defrosting of the freezer compartment.

Typically, a collection pan is located in a bottom section of the refrigerator case unit that houses the freezer and other cooling compartments of the refrigerator unit. Water is conveyed through a drain tube to the collection pan where collected water is trapped and evaporated. Usually, the heat of a motor unit in the bottom section assists in the evaporation of the collected water. Such collection of the defrosted water from the main compartment and its evaporation is well-known in the art. For example, U.S. Pat. No. 3,696,632 discloses a collection pan that is set so that a liquid level therein covers a drain tube end to prevent outside air from entering the refrigerator case. U.S. Pat. No. 4,783,971 discloses a drain pan configuration that has a pair of spaced mounting bracket with longitudinal guide slots and upward cones providing drip areas. U.S. Pat. No. 4,876,861 discloses a defrost water vaporizer having a capillary vaporizing element that increases a surface area to allow for greater evaporation. U.S. Pat. No. 5,271,241 discloses a water spreader that facilitates evaporation.

In some newer refrigerator unit models, an ice maker unit has been included on an upper door of the refrigerator. However, in this configuration, a simple drain tube extending from the ice maker unit to the collection pan is impractical as the tube would be stressed by continual movement as the door is opened and closed. Such movement would create a problem in managing the defrost water flow, particularly if the door is left opened.

Hence, a device is needed for controlling the flow of and/or removing drain fluid developed in a door of a refrigerator.

BRIEF DESCRIPTION OF THE INVENTION

An embodiment of the invention is directed to a refrigerator including a main body defining an upper compartment and a lower compartment, with the upper compartment having a frontal access opening, the main body including a drain fluid removal system. A door is pivotally mounted to the main body for selectively closing the frontal access opening, the door having a lower portion. The refrigerator further includes a drain fluid transfer system for transfer of drain fluid from the door to the drain fluid removal system.

Another embodiment of the invention is directed to a refrigerator including a main body defining an upper compartment and a lower compartment, the upper compartment having a frontal access opening. A door is pivotally mounted to the main body, and is movable from a closed position for selective access to the interior of the upper compartment through the frontal access opening. The door includes a source of drain fluid. The refrigerator further includes a drain fluid removal system and a drain fluid transfer system extending from the source of drain fluid to the drain fluid removal system. The drain fluid transfer system includes a valve assembly selectively movable between a first position and a second position. The valve assembly is operative in the first position to permit fluid flow from the source of drain fluid to the removal system; and the valve assembly is operative in its second position to inhibit fluid flow from the source to the removal system. The first position is selected when the door in its closed position, and the second position is selected when said door is not in its closed position.

Other features and advantages of this invention will be better appreciated from the following detailed description.

BRIEF DESCRIPTION OF THE DRAWINGS

Advantages and features of the invention may become apparent upon reading the following detailed description and upon reference to the drawings in which.

DETAILED DESCRIPTION OF EXEMPLARY EMBODIMENTS OF THE INVENTION

Figure 1:
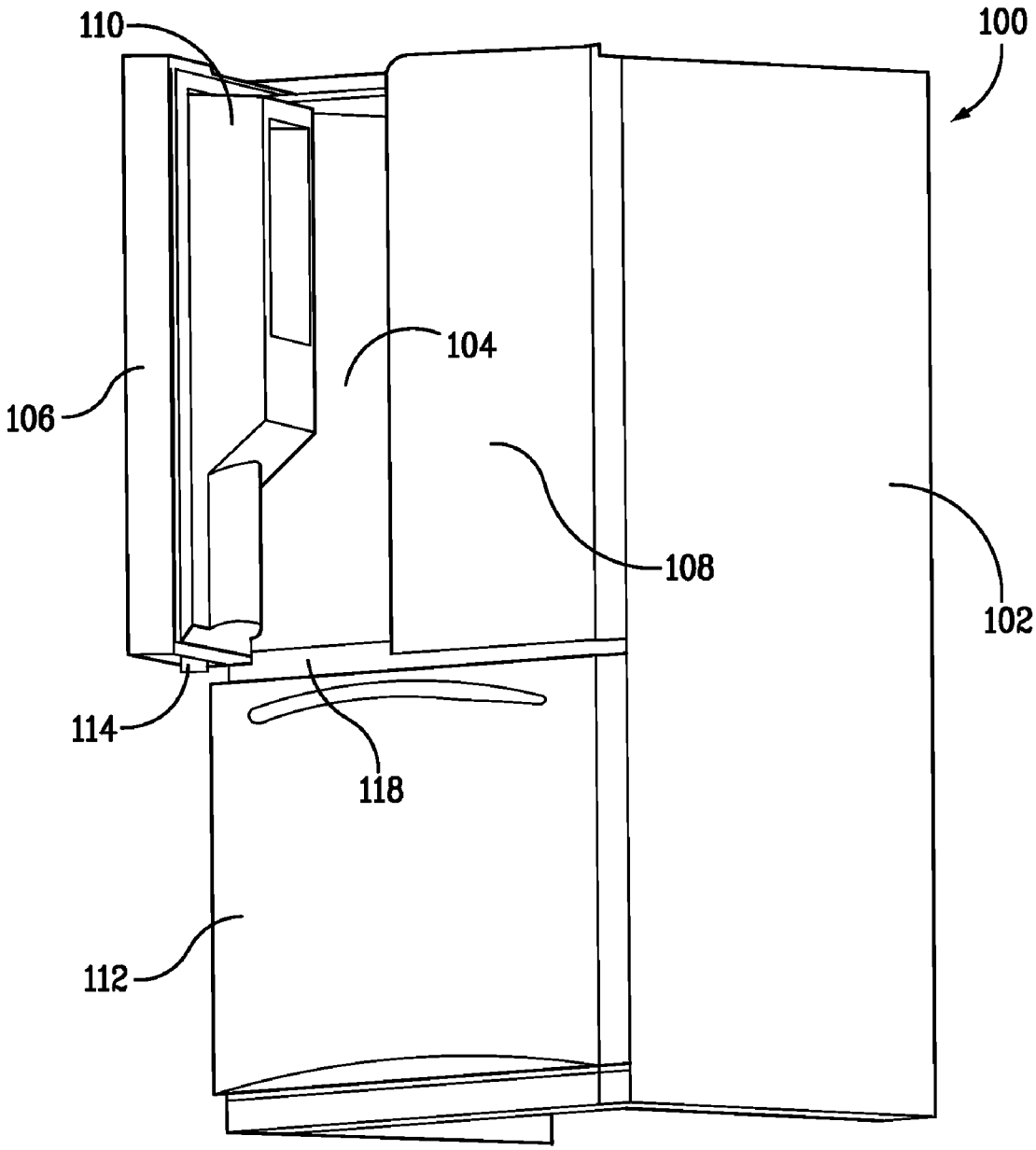
FIG. 1 is a perspective view of refrigerator unit including an embodiment of the invention described herein.

As noted, embodiments of the present invention may relate to a refrigerator having at least a main body (sometimes referred to as a "case" or "main case"), which is defined into an upper compartment and a lower compartment. The upper compartment generally has an opening for frontal access, and at least one door for selectively closing access to this opening. In many cases, the frontal access is for a fresh food compartment of the refrigerator, but the invention is not to be limited to such instances. Similarly, in many embodiments, the lower compartment may also contain a bottom freezer compartment for frozen food, but again, the invention is not to be limited in such manner.

The door for the upper compartment has at least a lower portion thereof. There may optionally also be a second door, to give a French door configuration. The lower compartment of the main body of the refrigerator generally includes at least the feature of a drain fluid removal system. On the main body of the refrigerator, at an upper region thereof, is generally supported a hinge assembly. The hinge assembly in turn pivotally supports the at least one door. The refrigerator further includes a drain fluid transfer system extending from the door to the lower compartment for transfer of drain fluid from the door to the drain fluid removal system.

As used herein, the term drain "fluid" usually will refer to a liquid predominantly composed of water, but which may also contain other components. Typically, a drain fluid removal system in the lower compartment will include any appropriate tubing, valving, collectors (e.g., pan), heaters, and/or evaporators (e.g., fan) capable of removing (e.g., evaporating) unwanted drain fluid. Many drain fluid removal systems are known in the field. A drain fluid removal system may include collection pans and employ the waste heat from a motor to foster removal and evaporation of drain fluid.

In accordance with embodiments of the invention, there may be one or more causes of drain fluid in a door. These may include, but are not limited to, defrost water developed from defrosting of an icemaker, and melting of ice contained in an ice bucket adjacent an icemaker.

In order to solve the problem of transferring drain fluid from the door, the refrigerator further includes the aforementioned drain fluid transfer system. This drain fluid transfer system, which generally extends from the door to the lower compartment, may take a wide variety of forms, all of which have in common the capability of achieving the transfer of drain fluid from the door to the drain fluid removal system. In certain embodiments, the drain fluid transfer system may include a transfer tube through which drain fluid is conveyed. In some embodiments, this transfer tube extends from an appropriate location in the door, and then out of the door into the hinge assembly, in which it will be at least partially enclosed. In such embodiments, the hinge assembly will be configured in a manner effective to both pivotally support the door and to enclose the transfer tube. Such hinge assembly may also be configured to at least partially enclose the piping structure which conveys a cooling medium (e.g., a glycol solution) used to cool a part or all of the refrigerator.

In certain embodiments, the drain fluid transfer system may include a valve assembly typically positioned at the lower portion (e.g., at a bottom edge) of the door, which door selectively closes the frontal access opening of the upper compartment. The characteristic feature of such valve assembly, where employed, is that it is selectively operable in a first position for allowing drain fluid to flow from the door to the lower compartment, and selectively operable in a second position for inhibiting drain fluid to flow from the door. Usually, the valve assembly will be configured to select the first position when the door closes the frontal access opening, and is configured to select the second position when the door is open.

A valve assembly in accordance with embodiments of the invention may be actuated by any appropriate manner, so long as it is selectively operable to inhibit drain fluid to flow from the door when not desired, e.g., when the door is open. Such actuation may be electromechanical (e.g., a motion sensor), or electro-optic (e.g., a photosensor), or mechanical (for example, a cam mechanism). Mechanical actuation provides simplification, and will be thus described in more detail here.

Referring now to FIG. 1, here is shown a perspective view of a typical refrigerator 100 which forms the context in which the drain fluid transfer system in accordance with embodiments of the invention may be used. Refrigerator 100 includes a main body (or case unit) 102, bottom door 112 supported by the main body 102, and top doors 106, 108 pivotally supported by the main body 102. In this illustrative embodiment, doors 106, 108 enclose an upper, fresh food compartment 104. Bottom door 112 may enclose, for example, a lower, freezer compartment within main body 102. The fresh food compartment 104 provides for a temperature sufficient to maintain the items therein at a cool, but not freezing, temperature. A freezer compartment maintains a temperature that is below a freezing temperature. Also shown is ice generating unit 110 on door 106. Ice generating unit 110 creates ice that is dispensed through a dispenser (not shown) on the front of door 106. The ice generating unit 110 retains a temperature sufficient to maintain ice within the fresh food compartment.

The doors 106, 108 shown in FIG. 1 form a French door configuration; however, it would be recognized that the embodiment of the invention described herein is applicable to other styles of refrigerator units. For example, the embodiment of the invention may also be applied to refrigerator units that are referred to as side-by-side, single door-top freezer and single door-bottom freezer.

Also shown in FIG. 1 is valve assembly 114 and a mullion 118 positioned between doors 106 and 108 on the one hand, and door 112 on the other. Valve assembly 114 is positioned at the bottom edge of door 106.

Figure 2:
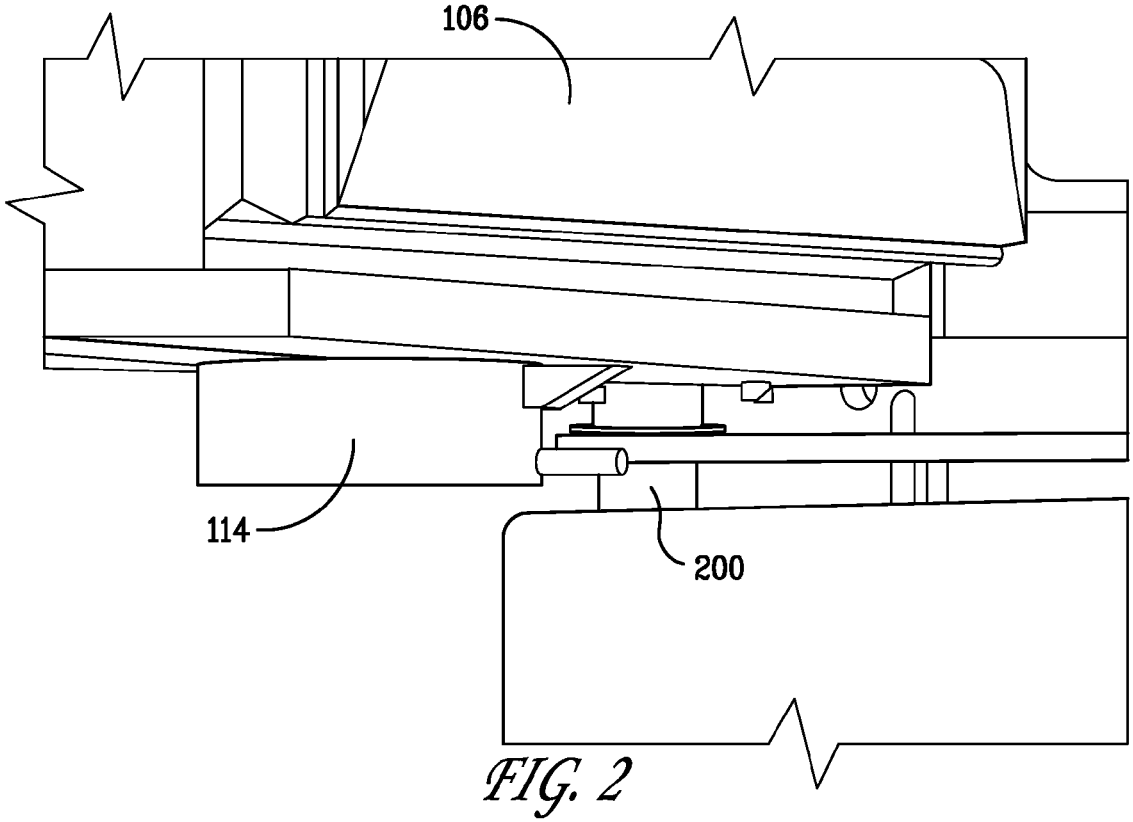
FIG. 2 is an expanded view of an embodiment of the valve assembly described herein.

FIG. 2 is an expanded view of valve assembly 114 positioned at the bottom edge of door 106. In this exemplary embodiment, valve assembly 114 is connected to a bottom edge of door 106 and thus rotates with door 106 about hinge assembly 200.

Figure 3:
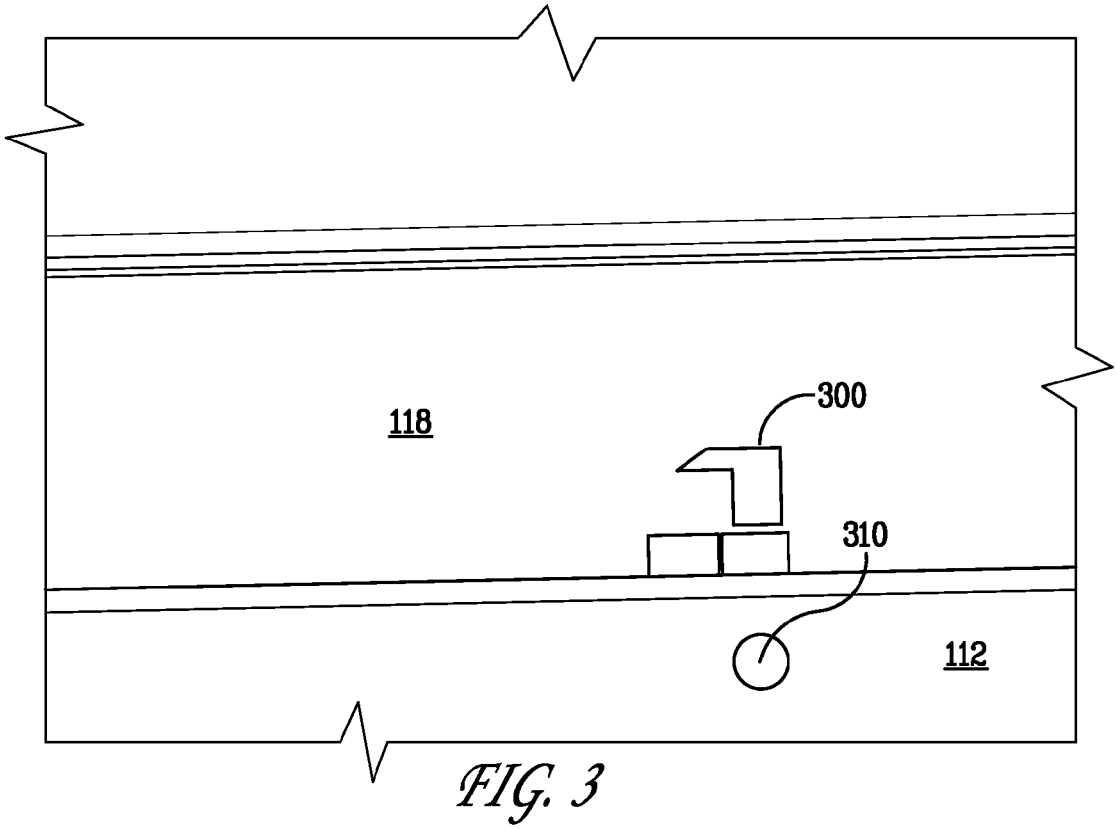
FIG. 3 is an expanded view of a mechanism for operating the valve assembly illustrated in FIG. 2, in accordance with an embodiment of the invention.

FIG. 3 illustrates an expanded front view of mullion 118 that is positioned on main body case 102. This mullion 118 serves to separate fresh food compartment 104 from the lower compartment of the main body 102. On mullion 118 is an engagement mechanism or cam 300 that operates with valve assembly 114 to control the valving portion located within valve assembly 114. Cam 300 may also be positioned at other locations on the lower compartment of main body 102 provided it may engage the valve assembly 114. Also depicted schematically is drain connection 310, which is represented as a port into lower door 112 that allows water transferred through valve assembly 114 to be transferred to a location in the main body 102 where it may be drained to the conventional drain collection pan located, e.g., in the lower compartment. This drain connection 310 may also be placed at other suitable locations, e.g., as a port into main body 102.

Figure 4:
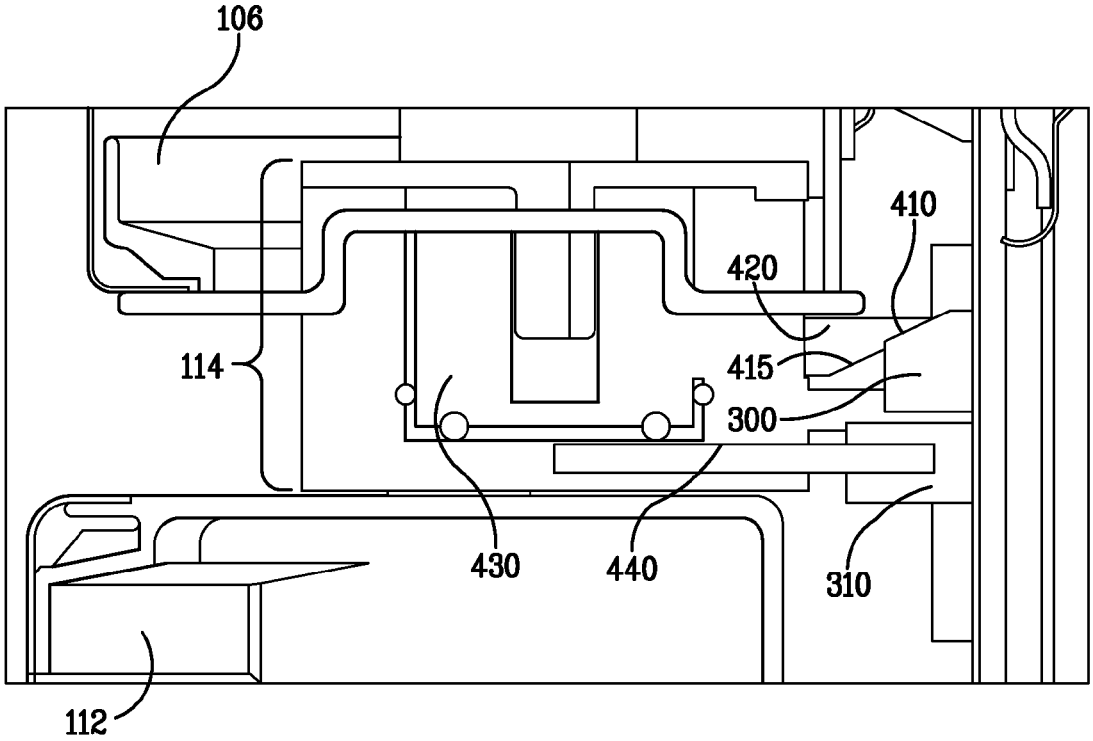
FIG. 4 is an expanded side view of the embodiment of the valve assembly illustrated in FIG. 2, in accordance with an embodiment of the invention.

FIG. 4 is an expanded cross-sectional side view of valve assembly 114 attached to the bottom edge of door 106. Valve assembly 114 includes, in part, a moveable valving portion 430 from which an arm 420 extends. As shown, cam 300 includes a cam surface 410 that is capable of engaging an opposing arm surface 415 on arm 420. Arm 420 extends from valving portion 430 such that cam surface 410 on cam 300 and arm surface 415 on arm 420 engage when door 106 is closed, and disengage when door 106 is opened. When door 106 is in a closed position, arm surface 415 slides up on cam 300. Although cam 300 is shown as extending from mullion 118, in another aspect of the invention, which is not shown, cam 300 may be on the lower compartment of main body 102. In this aspect, arm 420 would extend into main body 102 to engage cam 300.

Valving portion 430 functions to allow or inhibit drain fluid from door 106 (e.g., defrost water from ice generating unit 110) from entering a discharge tube 440. Discharge tube 440, when engaging drain connection 310 (FIG. 3), directs the flow of drain fluid from door 106 (through valve assembly 114) to a conventional collection pan (in the lower compartment of main body 102) used for evaporation of defrost water, as previously described.

In operation, valving portion 430 is lifted within valve assembly 114 as arm 420 engages cam 300 to cause valving portion 430 to open and allow the passage of water to discharge tube 440 and drain connection 310. When door 106 is opened (or otherwise not closed or not fully closed), arm surface 415 of arm 420 disengages cam surface 410 of cam 300 causing valving portion 430 to return to a position that inhibits the flow of water from door 106 to discharge tube 440. In some embodiments, the inclined surfaces 410 (camber) of cam 300 and 415 (wedge) of arm 420 operate as a cam to cause the lifting movement of valving portion 430. In order to provide a force to cause valving portion 430 to be pushed down when arm 420 disengages cam 300, a force applier or other form of bias such as a spring may be used. In this lowest position, valving portion 430 is referred to as being in a closed position.

Figure 5A:
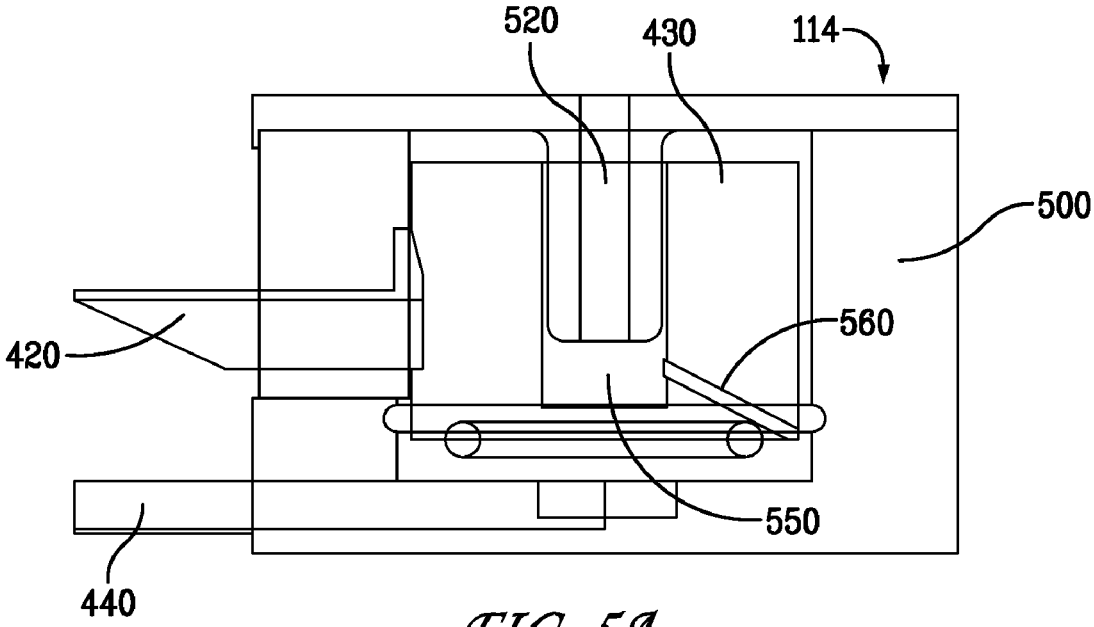
FIGS. 5A-5B are perspective and side views, respectively, of the valve assembly in an open position, in accordance with an embodiment of the invention.

FIG. 5A is a cross-sectional view of valve assembly 114 showing a housing 500 including valving portion 430 in an open position. Housing 500 includes inlet 520 that allows water to flow to a collection area 550 (defined by the shape of a cavity within valving portion 430) and then through channel 560 (extending through valving portion 430), out to discharge tube 440. In this illustrated view, arm 420 is shown extending from valving portion 430 through housing 500.

Figure 5B:
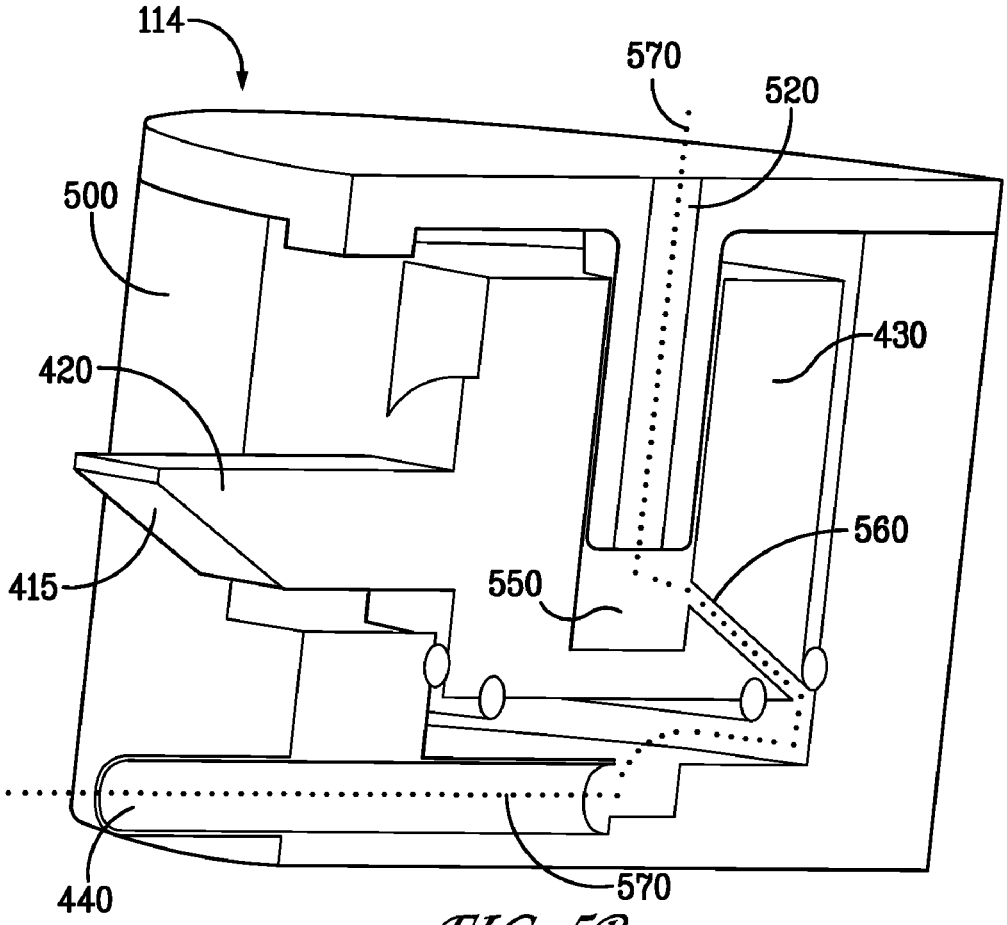

FIG. 5B is a perspective view of valve assembly 114 showing the flow of water (path 570) through inlet 520, into collection area 550, through channel 560, and into discharge tube 440.

Figure 6A:
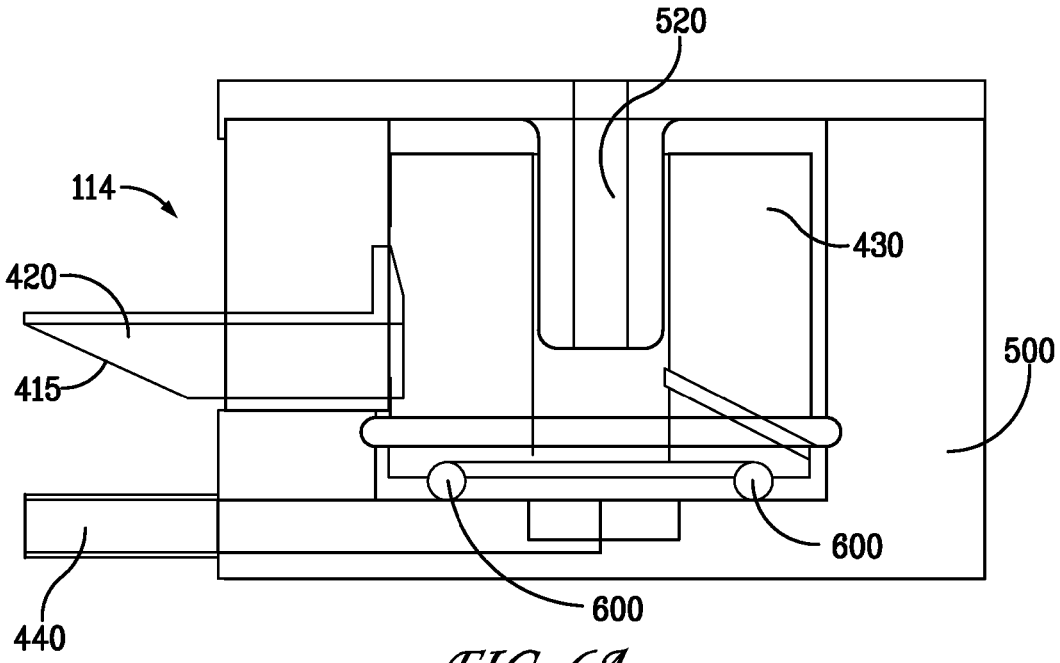
FIGS. 6A-6B are perspective and side views, respectively, of the valve assembly in a closed position, in accordance with an embodiment of the invention.
Figure 6B:
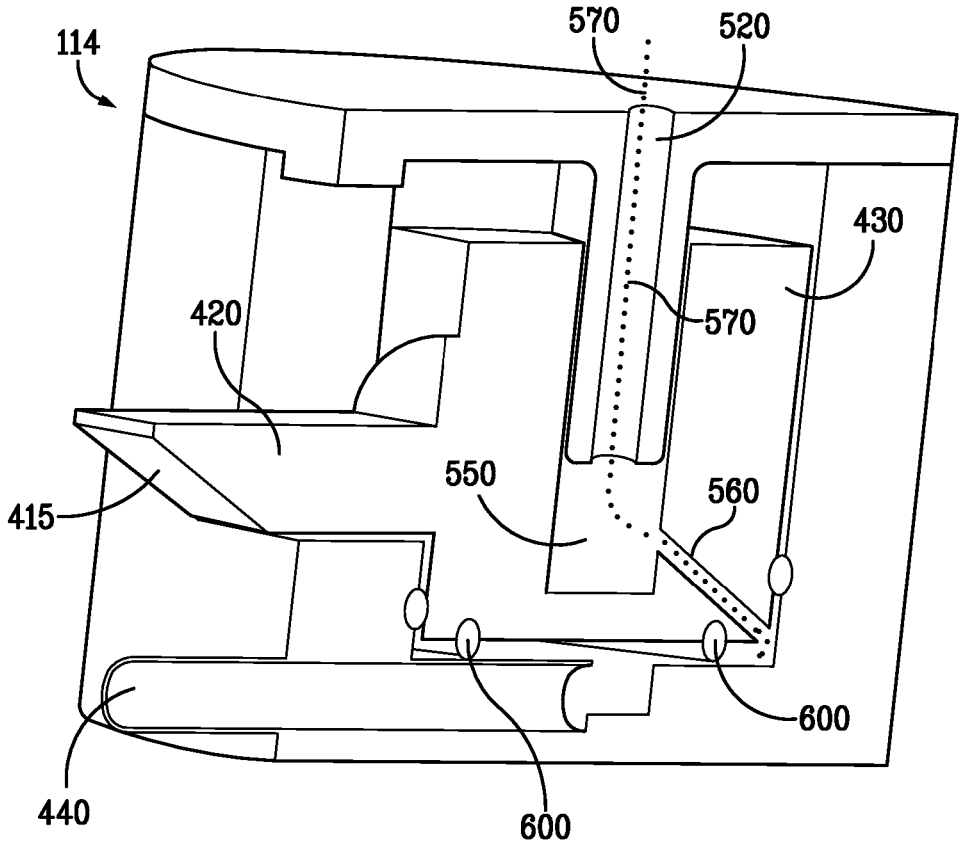

FIG. 6A is a cross-sectional view of valve assembly 114 showing housing 500 including valving portion 430 in a closed position. As noted, valving portion 430 may be pushed down by a force applier (e.g., a spring) as arm 420 disengages cam 300 to cause the flow of water to discharge tube 440 to be inhibited. Seals or gaskets 600 on valving portion 430 assist in making a water-tight seal to inhibit flow. FIG. 6B shows a perspective view of valving portion 430 in a closed position, wherein water flow is inhibited from entering discharge tube 440. Again shown are seals or gaskets 600 that are used to inhibit water flow (path 570) in this closed position. Although only two such seals are shown, other numbers of seals or sealing mechanisms may be employed to assist in preventing drain fluid leakage.

In this closed position, collection area 550 collects drain fluid that may be formed when door 106 is opened. When the door is closed, the valving portion 430 opens and the drain fluid accumulated in collection area 550 is allowed to pass to discharge tube 440.

Figure 7:
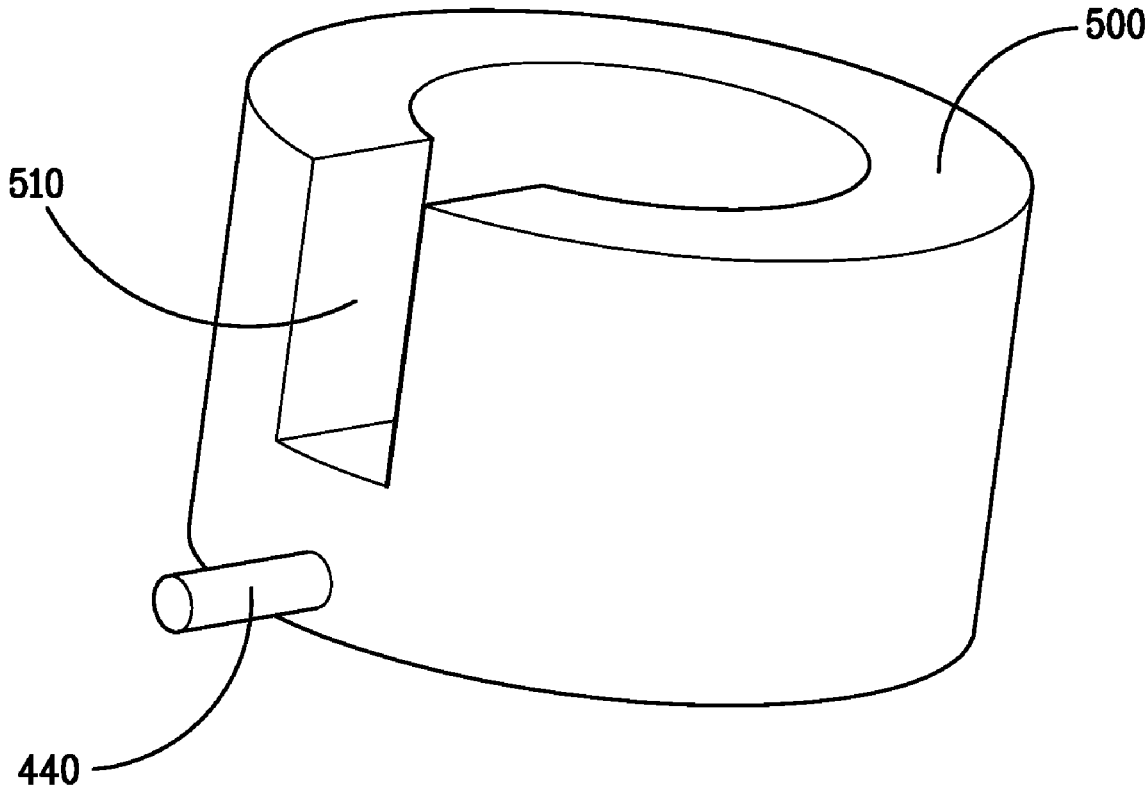
FIG. 7 is a perspective view of the valve assembly housing, in accordance with an embodiment of the invention.

FIG. 7 is a perspective view of the housing 500 of valve assembly 114. Housing 500 is of a generally circular cross-section, here shown as including a slot 510 extending from the top surface of housing 500. Slot 510 allows for the vertical movement of arm 420 of valving portion 430. Below slot 510 is discharge tube 440, which extends into a cavity formed in housing 500.

Figure 8A:
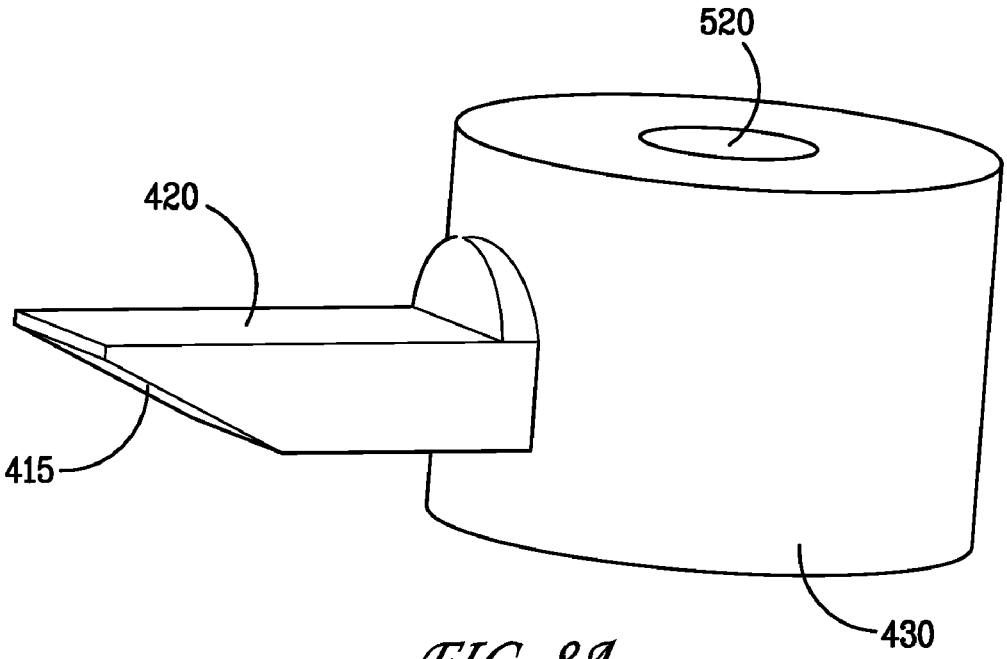
FIGS. 8A-8B are perspective views of the valving portion of the valve assembly, in accordance with an embodiment of the invention.
Figure 8B:
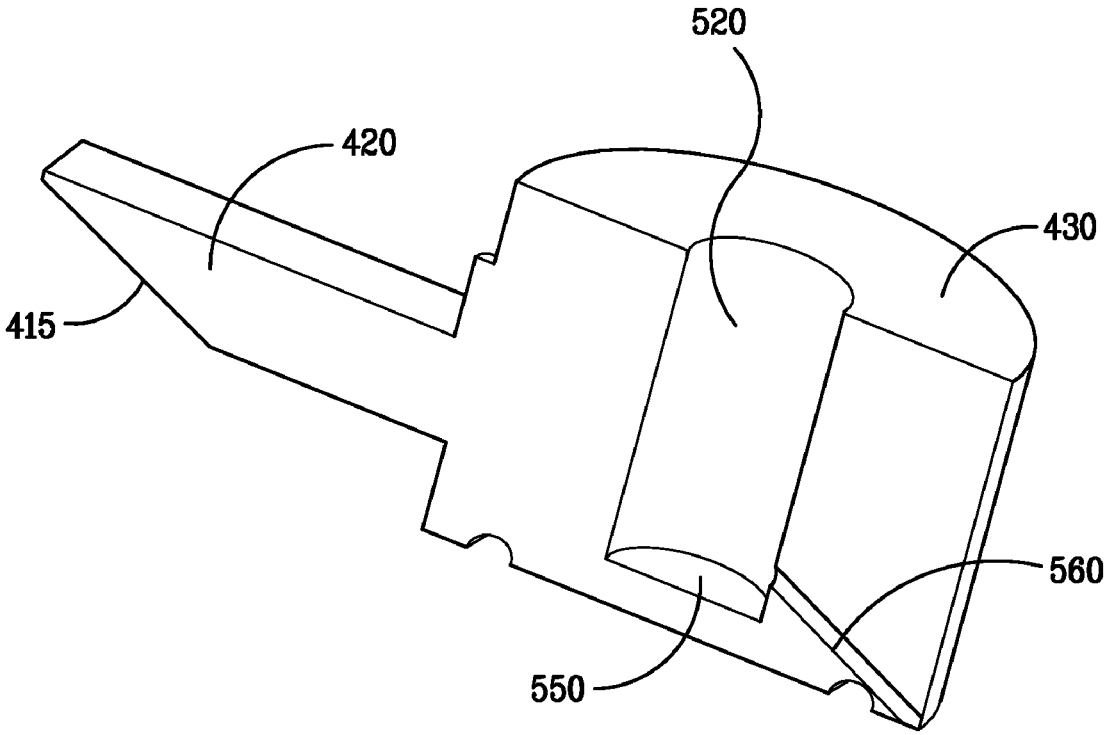

FIGS. 8A-8B are perspective views of valving portion 430 showing a cylindrical shape from which arm 420 extends. Valving portion 430 is sized to slidably fit within housing 500 (FIG. 7). Also shown is inlet 520 that allows for the direction and collection of drain water from door 106 (FIG. 1). FIG. 8B shows collection area 550 at the bottom of inlet 520. Also shown is channel 560 within the valving portion 430 extending from collection area 550. Channel 560, as previously described, allows drain fluid collecting in collection area 550 to be discharged to discharge tube 440.

Although the embodiment of the invention described herein teaches the opening of the valve when the valve assembly is lifted from a first to a second position by the closing of the compartment door and the closing of the valve occurs when the valve assembly is returned to the first position by the opening of the door, it should be recognized that a similar open operation may be performed in a valve assembly in which the valve is lowered from a first position to a second position by the closing of the door and the closing of the valve occurs when the valve assembly returns to its first position by the opening of the door. Such alteration in the operation of the valve assembly has been contemplated and considered to be within the scope of the invention claimed.

Figure 9:
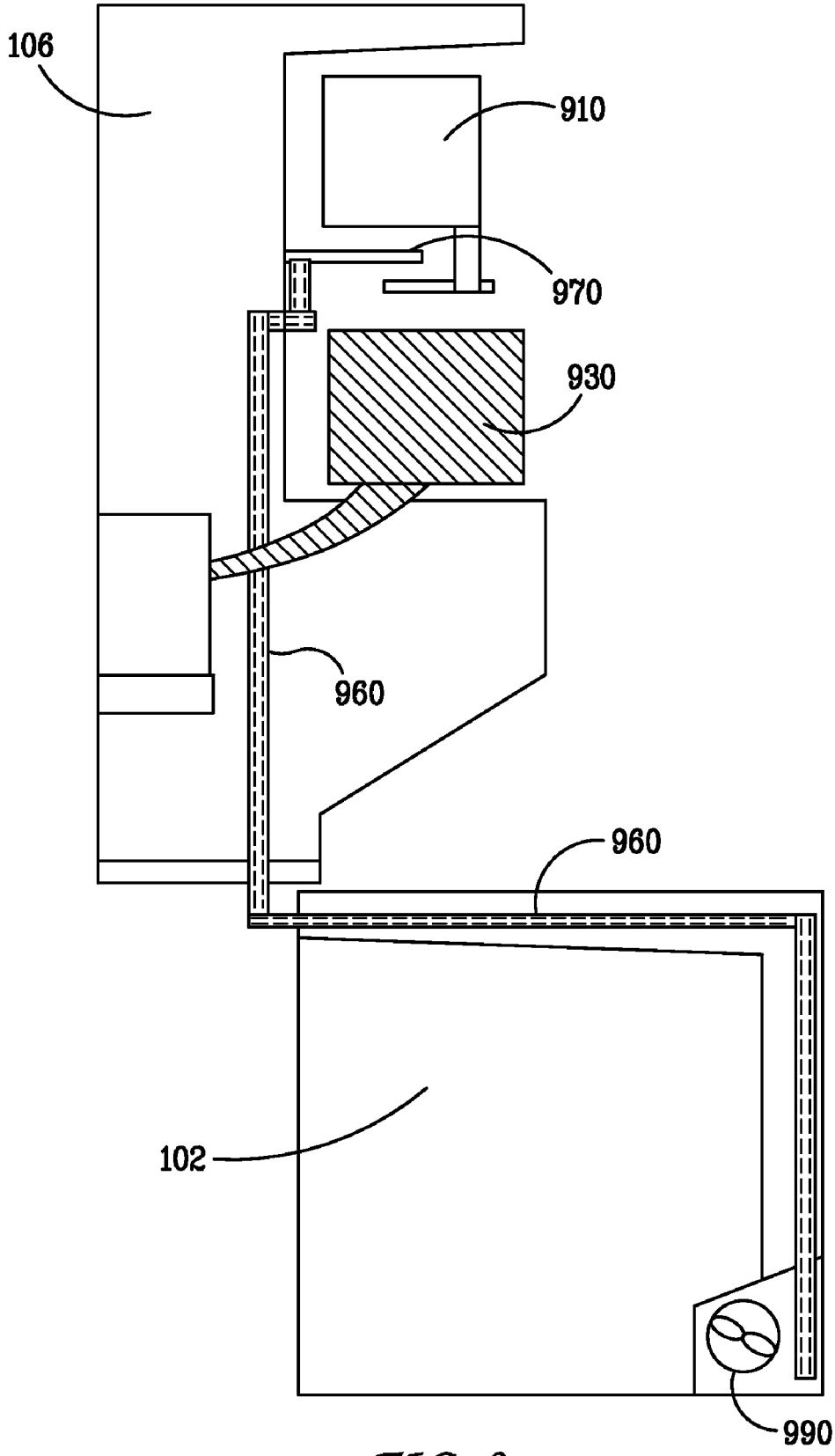
FIG. 9 is a side view of a drain fluid transfer system in accordance with another embodiment of the invention.

FIG. 9 is a side view of drain fluid transfer system in accordance with another embodiment of the invention. In this embodiment, the drain fluid transfer system comprises a transfer tube 960 for transferring drain fluid from the door to the lower compartment, wherein the transfer tube is at least partially enclosed in the hinge assembly 200 (FIG. 2). In the illustrative embodiment of FIG. 9, door 106 typically comprises an ice generating unit which is composed of an ice maker 910 that converts an input water (not shown) into ice. The formed ice is collected in ice bucket 930. The manner in which ice delivery to the ice bucket 930 is controlled, is conventionally known. Also shown is drain pan 970 positioned below ice maker 910. Although only one drain pan is shown in the door 106, it is understood that other pans may be present where needed to collect drain fluid, such as under ice and water dispensers in the door 106. Drain pan 970 collects water that may spill either during the period that water is allowed to flow to ice maker 910, or during the conversion of the water into ice. Drain pan 970 is connected to transfer tube 960. Transfer tube 960 directs the flow of water from drain pan 970 through hinge assembly 200 (FIG. 2) to the lower compartment of main body 102. Within main body 102, transfer tube 960 directs the flow of water to condenser 990. Condenser 990, as is known in the art, creates an airflow that causes any water collected in a collection tray (not shown) to be evaporated.

Figure 10:
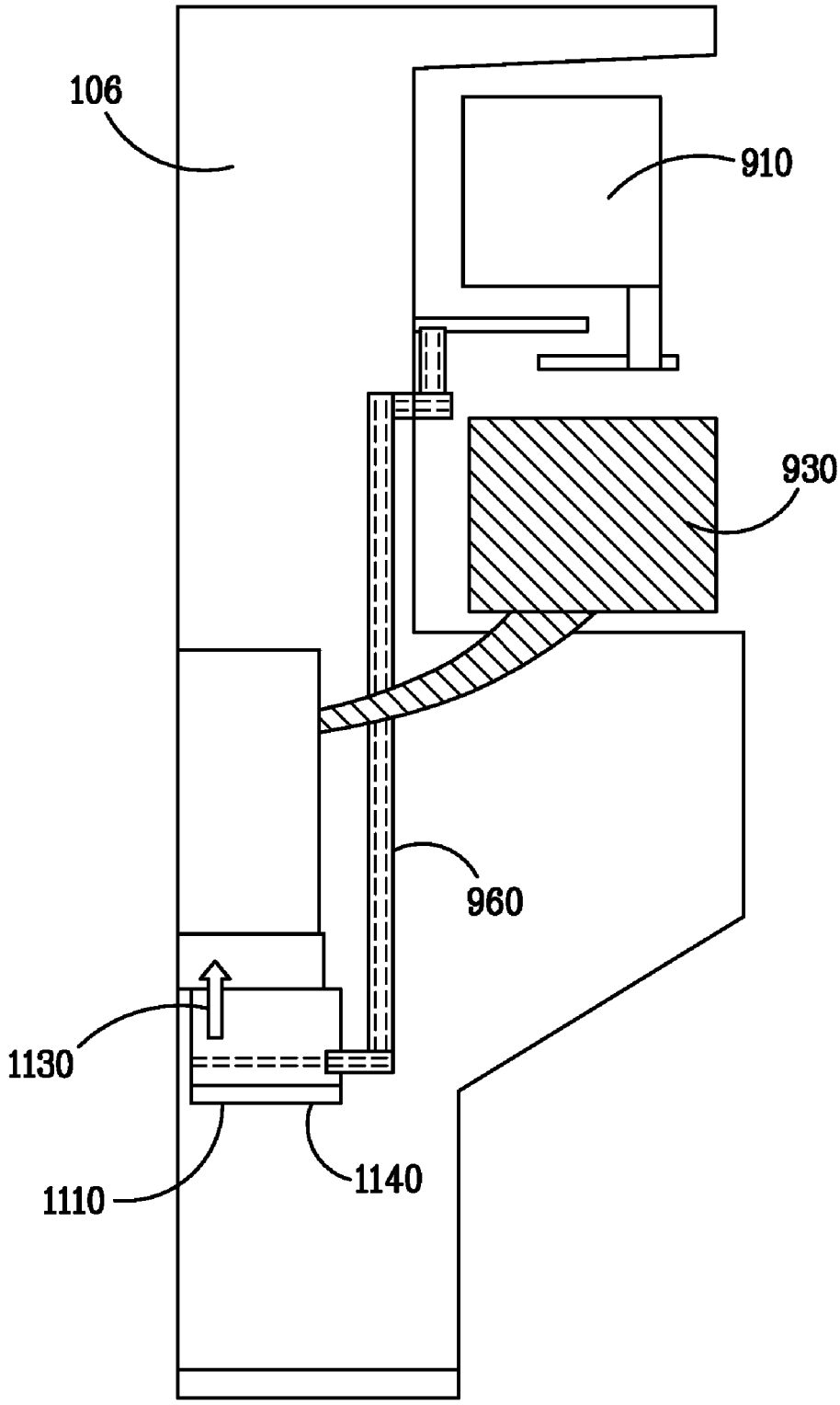
FIG. 10 is a side view of an on-door collection and evaporation system in accordance with another embodiment of the invention.

FIG. 10 illustrates a view of an on-door drain fluid transfer system in accordance with yet another embodiment of the invention. In this case, an on-door water collection unit 1110 is placed on door 106. Water collection unit 1110 collects water from ice maker 910 through transfer tube 960, and/or from other areas in door 106 from which drain fluid needs to be collected, such as under ice and water dispensers (not specifically shown) in the door 106. A heater unit 1140 may be incorporated into water collection unit 1110. The heater unit may heat the collected water to cause the evaporation of the collected water. The evaporated water is then vented through vent 1130.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" used in connection with a quantity is inclusive of the stated value and has the meaning dictated by the context (for example, includes the degree of error associated with the measurement of the particular quantity).

"Optional" or "optionally" means that the subsequently described event or circumstance may or may not occur, or that the subsequently identified material may or may not be present, and that the description includes instances where the event or circumstance occurs or where the material is present, and instances where the event or circumstance does not occur or the material is not present. The singular forms "a", "an" and "the" include plural referents unless the context clearly dictates otherwise. All ranges disclosed herein are inclusive of the recited endpoint and independently combinable. Finally, as used herein, the phrases "adapted to," "configured to," and the like refer to elements that are sized, arranged or manufactured to form a specified structure or to achieve a specified result.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A refrigerator comprising:

a main body defining an upper compartment and a lower compartment, the upper compartment having a frontal access opening;

a drain fluid removal system in the main body;

a door pivotally mounted to the main body for selectively closing the frontal access opening, said door having a lower portion; and a drain fluid transfer system for transfer of drain fluid from the door to the drain fluid removal system;

said refrigerator further coin rising a hinge assembly supported on the main body for pivotally mounting said door, and wherein said drain fluid transfer system comprises at least one transfer portion selected from the group consisting of: transfer tube at least partially enclosed in the hinge assembly; and valve assembly positioned at the lower portion of the door.

2. The refrigerator of claim 1, wherein said drain fluid transfer system comprises a valve assembly positioned at the tower portion of the door, and wherein said valve assembly is selectively operable in a first position for allowing drain fluid to flow from the door to said drain fluid removal system and in a second position for inhibiting drain fluid to flow from the door.

3. The refrigerator of claim 2, wherein said valve assembly is configured to select the first position when the door closes the frontal access opening, and is configured to select the second position when the door is open.

4. The refrigerator of claim 2, said refrigerator further comprising:

a cam attached to a surface of the main body, and a drain collection port attached to a surface of the main body, said port in fluid communication with the drain fluid removal system.

5. The refrigerator of claim 4, wherein said valve assembly comprises:

a discharge tube engaging said drain collection port when said door is in a closed position; and a valving portion having an arm extending therefrom, said arm having an end configured to operatively engage said cam, for movement of said valve assembly to said first position when said door closes.

6. The refrigerator of claim 5, wherein said valve assembly further comprises:

a housing including a slot through which said arm extends, said valving portion at least partially contained within said housing.

7. The refrigerator of claim 5, further comprising:

a force applier for returning said valve assembly to the second position for inhibiting drain fluid to flow from the door when said arm is disengaged from said cam.

8. The refrigerator of claim 1, wherein said drain fluid removal system comprises a fluid collection pan and a heater.

9. The refrigerator of claim 1, wherein said door includes a source of drain water.

10. The refrigerator of claim 9, wherein said source of drain water comprises an ice generating unit.

11. The refrigerator of claim 1, wherein said drain fluid transfer system comprises a transfer tube at least partially enclosed in the hinge assembly.

12. The refrigerator of claim 1, further comprising a cooling medium piping structure, said piping structure at least partially enclosed in the hinge assembly.

13. A refrigerator comprising:

a main body defining an upper compartment and a lower compartment, the upper compartment having a frontal access opening;

a door pivotally mounted to said main body and movable from a closed position for selective access to the interior of said upper compartment through said frontal access opening, said door including a source of drain fluid, wherein said source of drain fluid comprises an ice generating unit;

a drain fluid removal system; and a drain fluid transfer system extending from the source of drain fluid to the drain fluid removal system, said drain fluid transfer system including a valve assembly selectively movable between a first position and a second position, said valve assembly being operative in said first position to permit fluid flow from said source to said removal system and operative in said second position to inhibit fluid flow from said source to said removal system, said first position being selected when said door in its closed position and said second position being selected when said door is not in its closed position.

14. The refrigerator of claim 13, wherein said drain fluid removal system comprises a water collection unit, a heater unit, and a vent.

* * * * *

UNITED STATES PATENT AND TRADEMARK OFFICE

CERTIFICATE OF CORRECTION

PATENT NO. : 8,240,159 B2
APPLICATION NO. : 12/492539
DATED : August 14, 2012
INVENTOR(S) : Prabhakar et al.

It is certified that error appears in the above-identified patent and that said Letters Patent is hereby corrected as shown below:

In Column 7, Line 28, in Claim 1, delete "coin rising" and insert -- comprising --, therefor.

In Column 7, Line 38, in Claim 2, delete "tower" and insert -- lower --, therefor.

Signed and Sealed this
Ninth Day of April, 2013

Teresa Stanek Rea
*Acting Director of the United States Patent and Trademark Office*